United States Patent [19]

Oettinger

[11] 4,331,509

[45] May 25, 1982

[54] DIGESTER STRAINER LOCKING ASSEMBLY

[75] Inventor: John F. Oettinger, Portland, Oreg.

[73] Assignee: ESCO Corporation, Portland, Oreg.

[21] Appl. No.: 166,371

[22] Filed: Jul. 7, 1980

[51] Int. Cl.[3] ..... D21C 7/00; E04C 1/40

[52] U.S. Cl. ..... 162/251; 52/508

[58] Field of Search ..... 162/251; 52/508, 762, 52/766, 777, 509

[56] References Cited

U.S. PATENT DOCUMENTS 3,832,820 9/1974 Eggert ..... 52/762

4,040,901 8/1977 Leisure ..... 162/251

FOREIGN PATENT DOCUMENTS 250639 11/1966 Fed. Rep. of Germany ..... 52/762

*Primary Examiner*—Marc S. Alvo

*Attorney, Agent, or Firm*—Tilton, Fallon, Lungmus & Chestnut

[57] ABSTRACT

A digester strainer locking assembly for strainer panels supported interiorly of a generally cylindrical digester vessel wherein a socket member receives a clamp lock member and a lock member all wedgingly interrelated to clamp the panels releasably in place.

1 Claim, 4 Drawing Figures

FIG. 1
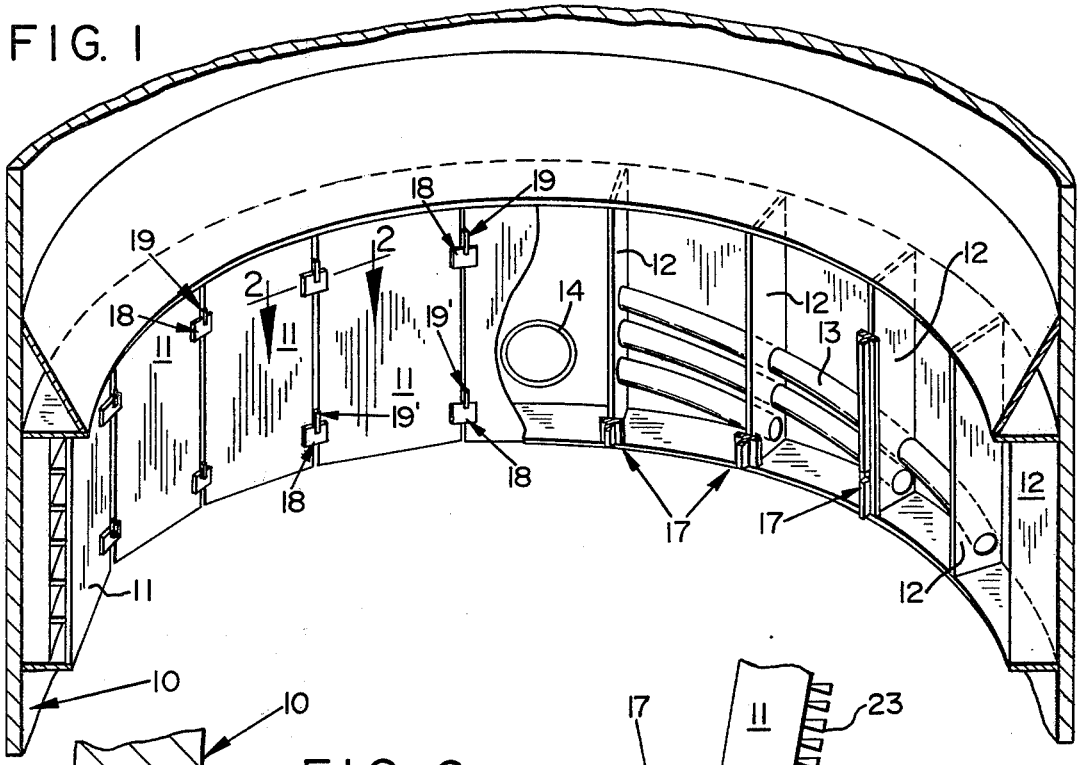
FIG. 2
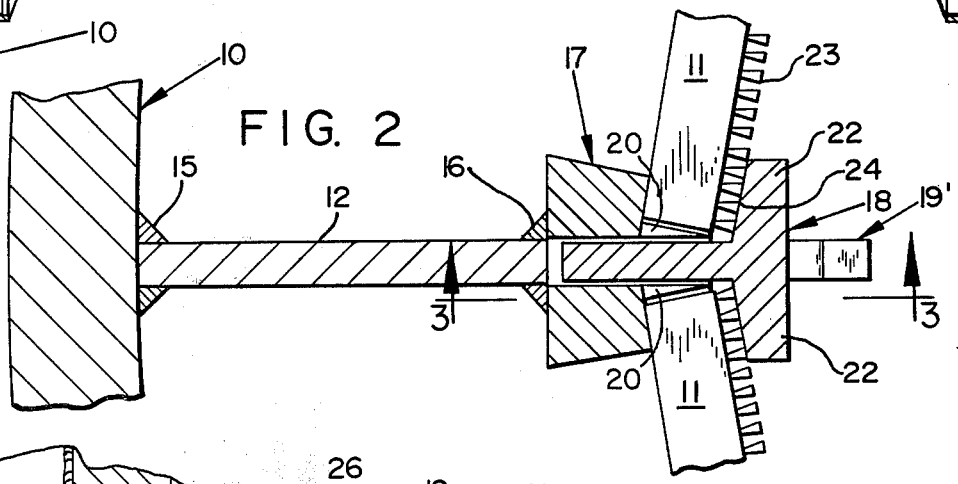
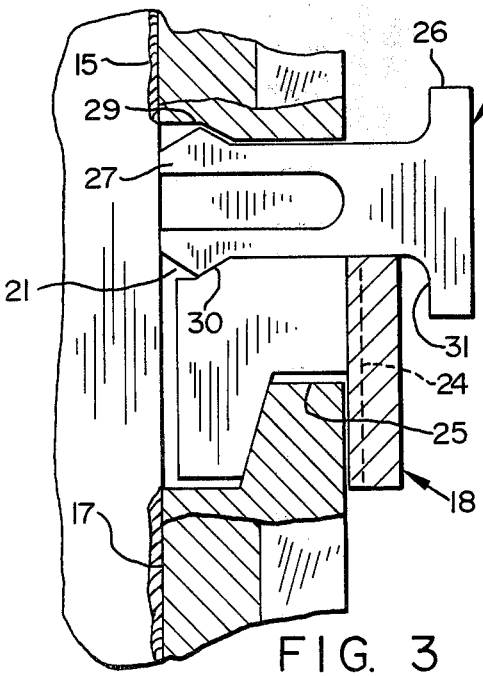
FIG. 3
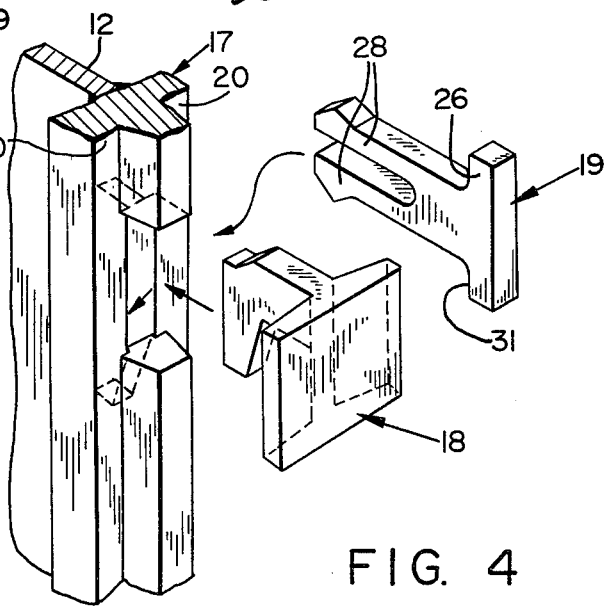
FIG. 4

DIGESTER STRAINER LOCKING ASSEMBLY

BACKGROUND AND SUMMARY OF INVENTION

This invention relates to a strainer locking assembly for a digester vessel and constitutes an improvement on co-owned U.S. Pat. Nos. 2,163,437; 2,852,369 and 4,040,901.

In the manufacture of most types of pulp, with which to make paper or board, from wood particles, the wood particles are initially subjected to chemical action at elevated pressure and temperature. This process is known in the pulp-making trade as "digesting", and takes place in pressure vessels known as "digesters". The process may be accomplished by filling the digester with wood particles and closing the digester while the process takes place, known as "batch digesting", or may be accomplished by continuously filling the digester with wood particles while simultaneously removing processed material, known as "continuous digesting".

In any of these instances, the process chemicals are added to the digester vessel as an aqueous solution and water is contained in the wood particles, so the digester vessel is essentially filled with water containing process chemicals or chemicals dissolved from the wood particles, known as "liquor".

Frequently during the digesting process, it is desired to remove part of the liquor from the digester vessel, usually accomplished by allowing the liquor to flow through screened openings to outlet pipes. The screens covering the outlet openings allow the liquor to flow, but prevent the wood particles from leaving the vessel with the liquor.

The screens, i.e., strainer panels, over the outlet openings may be circular, rectangular or in the form of a horizontal ring around the inside circumference of the digester vessel. The ring is frequently made up from a number of abutting sections of screen mounted on frames for mechanical support and for attachment to the digester vessel wall. In practice, these screen sections may have to be removed and replaced periodically, i.e., for cleaning or maintenance, so it is desirable to have means of securing the screen sections in place in the digester vessel which is simple and easy to operate, highly reliable and inexpensive to make or use.

A number of disadvantages or defects have characterized the prior art expedients for securing the strainer panels or screen sections in place. In some instances these came loose unintentionally. In other instances the locking or securing devices were not simple and easy to use—more particularly, they could be installed correctly. In many instances threaded fasteners were employed which could corrode or gall. In other instances the components of the lock were not sturdy and could be broken during installation or removal. All of these are avoided according to the instant invention which has an additional significant advantage of being disassembable for ready removal of strainer panels merely through the use of a pry bar and hammer. According to the invention, a socket member is provided between each pair of perimetrically related panels and is contoured so as to support the same. The socket member is equipped with a recess for wedgingly receiving both a clamp block member and a lock member which cooperate in both releasably maintaining each other in place within the socket recess and at the same time releasably clamping the adjacent strainer panels.

Other objects and advantages of the invention may be seen in the details of the ensuing specification.

DETAILED DESCRIPTION

The invention is described in conjunction with an illustrative embodiment in the accompanying drawing, in which:

FIG. 1 is a fragmentary perspective view, partially in section, of a digester vessel to which the instant invention has advantageous application;

FIG. 2 is an enlarged fragmentary sectional view such as would be seen along the sight line 2—2 of FIG. 1;

FIG. 3 is an enlarged fragmentary sectional view such as would be seen along the sight line 3—3 of FIG. 2; and FIG. 4 is an exploded perspective view of the lock assembly components of the instant invention.

In the illustration given and with reference first to FIG. 1, the numeral 10 designates generally the wall of a digester vessel which usually is provided in generally cylindrical form. As indicated above, pulp is provided therein from which the liquor must be extracted from time to time and this is achieved through a plurality of perimetrically related panels 11. For the purpose of supporting the strainer panels or screen sections, the interior of the vessel wall 10 is equipped with a number of bulkhead members as at 12 (see the right hand portion of FIG. 1). Piping as at 13 communicates the various sections to a central withdrawal opening as at 14. Makeup liquor is introduced into the vessel defined by the wall 10 at a point or points (not shown).

The bulkhead 12 can be seen in enlarged form in FIG. 2 and is seen to be weldably connected as at 15 along one vertical edge to the wall 10. At its inner end, the bulkhead 12 has weldably secured to it (as again by welding at 16) a socket member generally designated 17. The socket member receives in wedging fashion a clamp block member generally designated 18 and a lock member generally designated 19—these two members also being seen in FIG. 1.

In the operation of the invention, the adjacent strainer panels 11 are initially installed within ways 20 (see particularly FIG. 4) provided on the inwardly facing end of the socket 17. The ways 20 are suitably contoured so as to maintain the screen panels in a generally polygonal array within the generally cylindrical vessel wall 10. Thereafter, the clamp lock member 18 is introduced into the recess 21 (again see FIG. 4). The clamp block member 18 is generally T-shaped when viewed in plan as can be appreciated from FIG. 2. This T-shape provides integral wings as at 22 (still referring to FIG. 2) which are adapted to overlie and clampingly engage the strainer panels 11. In the illustration given, the strainer panels 11 have as filtering elements, wedge shaped wires as at 23 which provide a flat, angled inner facing surface engageable by the beveled surface 24 of the wings 22 of the clamp block member 18. As can be appreciated from FIG. 3, the recess 21 is flared so as to develop a wedging engagement of the clamp block member 18 relative to the socket member 17—this being apparent from the portion designated 25 in FIG. 3.

Completing the assembly is the lock member 19 which is a generally flat element having a head end as at 26 and a bifurcated end as at 27. The bifurcated end 27 provides spaced apart legs 28 which resiliently engage a portion of the socket 21 as at 29 and a wedge face 30 of the clamp block member 18. When installed, in the configuration depicted in FIG. 3, the head 26 is spaced from the socket member 17 and the clamp block member 18 so as to provide an advantageous protruberance for insertion of a pry bar—thereby facilitating removal.

Thus, the socket member 17 which is part of the bulkhead 12, receives the clamp block member 18 and the lock member 19 and tightens the clamp block member against the frame or face of the strainer panel 11 as the clamp block member 18 is driven downward with the wedge faces engaged, as at 25. The lock member 19 is then driven into the recess or cavity 21 of the socket member 17 above the clamp block member to prevent the clamp block member 18 from working loose and falling out of place. The lock member is driven into place by hammer blows, springing the locking tabs provided by the legs 28 together so that they ride over the top surface of the clamp block member 18 and the downwardly facing surface of the recess 21 to a point where these legs spring into place as at 29 and 30 to prevent unintentional removal of the clamp block member 18. The height of the locking means consisting of the members 18 and 19 fills the recess 21 so the clamp block member 18 cannot be unintentionally removed. The lock member 19 can be intentionally removed by prying between the exposed underside of the head portion as at 31, utilizing the interiorly facing surface (provided by the wings 22) of the clamp block member 18 as a prying means. Thus, the legs 28 are moved together so that the lock member 19 is available for easy removal over the top of the clamp block member 18. Thereafter the same operation is performed relative to the lower lock member 19' (compare FIGS. 1 and 2) and both vertically aligned locks are then ready for disassembly.

Among the advantages of the invention is that the locking assembly cannot come loose intentionally, it is simple and easy to use, it cannot be installed incorrectly, it does not use any threaded fasteners which can corrode or gall, the components are sturdy and cannot be broken during installation or removal and the only tool required for installation is a hammer, and for removal only a pry bar end hammer.

While in the foregoing specification a detailed description of an embodiment of the invention has been set down for the purpose of illustration, many variations in the details hereingiven may be made by those skilled in the art without departing from the spirit and scope of the invention.

I claim:

1. A digester strainer locking assembly for releasably supporting perimetrically related strainer panels mounted interiorly of a digester comprising:

a member containing a socket fixed to the digester interior and having horizontally-spaced apart, vertically extending ways for the receipt of said panels, said socket having a recess between said ways, a block wedgingly mounted in said recess and equipped with horizontally extending, integral wings for overlying and clamping said panels, and a lock also wedgingly mounted in said recess and resiliently engaging said block for releasably seating said block in said recess, said lock being equipped with integral head means for removal of said lock from said recess and with a pair of resilient legs for wedgingly engaging said socket and block members, said recess being flared inwardly to provide for wedging engagement with both said block and lock.

* * * * *